US006894667B1

(12) United States Patent
Lin

(10) Patent No.: US 6,894,667 B1
(45) **Date of Patent: *May 17, 2005**

(54) LIQUID CRYSTAL DISPLAY MODULE AND THE SCANNING CIRCUIT BOARD

(75) Inventor: Tien-Jen Lin, Hsinchu (TW)

(73) Assignee: Chi Mei Optoelectronics Corporation, Tainan (TW)

( * ) Notice: Subject to any disclaimer, the term of this patent is extended or adjusted under 35 U.S.C. 154(b) by 291 days.

This patent is subject to a terminal disclaimer.

(21) Appl. No.: 09/610,012

(22) Filed: Jul. 3, 2000

(30) Foreign Application Priority Data

Dec. 1, 1999 (TW) ..... 88120973 A

(51) Int. Cl.[7] ..... G09G 3/36

(52) U.S. Cl. ..... 345/87; 345/204; 345/98; 345/100

(58) Field of Search ..... 345/87, 98, 100, 345/204

(56) References Cited

U.S. PATENT DOCUMENTS 4,922,240 A * 5/1990 Duwaer ..... 340/784
5,168,270 A * 12/1992 Masumori et al. ..... 340/784
5,191,450 A * 3/1993 Yajima et al. ..... 359/54
5,365,284 A * 11/1994 Matsumoto et al. ..... 348/793
5,777,610 A * 7/1998 Sugimoto et al. ..... 345/206
5,781,171 A * 7/1998 Kihara et al. ..... 345/93
5,894,296 A * 4/1999 Maekawa ..... 345/98
6,023,260 A * 2/2000 Higashi ..... 345/100
6,121,950 A * 9/2000 Zavaracky et al. ..... 345/101
6,232,949 B1 * 5/2001 Imamura ..... 345/100
6,246,385 B1 * 6/2001 Kinoshita et al. ..... 345/87
6,266,041 B1 * 7/2001 Cairns et al. ..... 345/100
6,437,767 B1 * 8/2002 Cairns et al. ..... 345/100
6,480,180 B1 * 11/2002 Moon ..... 345/98

* cited by examiner

*Primary Examiner*—Regina Liang
*Assistant Examiner*—Jennifer T Nguyen
(74) *Attorney, Agent, or Firm*—Intellectual Property Solutions, Incorporated

(57) ABSTRACT

A LCD module and a scanning method of the LCD panel and its scanning circuit board. The main object is to configure a first scan driver circuit and a second scan driver circuit at both ends of each of the scanning line in the LCD panel respectively. During scanning, both the first scan driver circuit and the second scan driver circuit are used for carrying out the scanning procedure on every scanning line, therefore the delay effect caused by RC time constant is equivalently reduced. The first scan driver circuit and the second scan driver circuit allocated to the scanning circuit boards have the same circuit layout.

6 Claims, 6 Drawing Sheets

LIQUID CRYSTAL DISPLAY MODULE AND THE SCANNING CIRCUIT BOARD

BACKGROUND OF THE INVENTION

1. Field of the Invention

The present invention relates to a scanning technique of a LCD (liquid crystal display) panel. More particularly, this invention relates to a scanning circuit board of a LCD module with high resolusion and its scanning method.

2. Description of the Prior Art

FIG. 1 (Prior Art) is a plane view of a conventional LCD module. As shown in FIG. 1, the LCD module comprises a LCD panel 100, a data circuit board 120, a plurality of data driver integrated circuits (ICs) 122, a scanning circuit board 130, a plurality of scan driver ICs 132, and a driving circuit 110. Driving circuit 110 connects to data circuit board 120 via connecting line 112 for transferring corresponding data driving signals and scanning control signals. Data circuit board 120 then connects to scanning circuit board 130 through connector 125 for transferring scanning control signals to scanning circuit board 130. Data driver IC 122 and scan driver IC 132 are in the form of the tape carrier package (or called TCP). Data driver ICs 122 connect to data circuit board 120 at the upper part of LCD panel 100, and scan driver ICs 132 connect to scanning circuit board 130 at the left side of LCD panel 100. The display of the conventional LCD is achieved by using a back light source or other light sources, which would not be described here.

FIG. 2 (Prior Art) is a circuit diagram of the conventional LCD panel 100. Assume that the LCD panel is a color LCD. As shown in FIG. 2, the LCD panel comprises a pixel electrode 101 with an array of m rows and 3n columns. The number of the pixel electrodes 101 is m×3n. Additionally, each pixel electrode 101 is configured at the intersection of the scanning lines (represented as 102(1)~**102(*m*)) and the data lines (represented as 103(1)~103(*n*)), and the scanning lines are controlled with scan driver ICs 132, and the data lines are controlled with data driving ICs 122**.

In a color LCD, each pixel comprises three pixel electrodes 101 representing red, green and blue, respectively. Namely, a group of m×n pixel electrodes 101 is used to represent red and forms the R subpixels. Another group of m×n pixel electrodes 101 is used to represent green and forms the G subpixels. Finally, the rest of the m×n pixel electrodes 101 is used to represent blue and forms the B subpixel. As a result, the color LCD has a total pixel or point number of m×3n.

The first to the m-th scanning lines or electrodes 102(1) to **102(*m*) are respectively aligned along the rows of the array. The first to the 3n-th data lines or electrodes 103(1) to 103(3*n*) are respectively aligned along the columns of the array. Thus, thin film transistors (TFTs) 106 with a total number of (m×3n) are configured at the intersections of scanning lines from 102(1) to 102(*m*) and data lines from 103(1) to 103(3*n*), in order to drive each of m×3n pixel electrodes 101**.

Each TFT 106 on the same scanning line with its gate electrically links to the corresponding one of the scanning lines from 102(1) to **102(*m*). And each TFT 106 on the same data line with its drain electrically links to the corresponding one of the data lines from 103(1) to 103(*n*). The sources of all TFTs 106 electrically link to the corresponding pixel electrode 101**.

According to FIG. 1 and FIG. 2, the operation of the conventional LCD module is described below. First of all according to the current image data, driving circuit 110 sends the data driving signal to data circuit board 120 and sends the scanning control signal to scanning circuit board 130. According to the scanning control signal, scan driver IC 132 is able to scan every scanning line from 102(1) to **102(*m*) on the LCD panel. That is, scan driver IC 132 sends a logic high level signal to one of the scanning lines to turn on the TFTs 106 connected to this scanning line. On the other hand, data driver IC 122 sends the image data to the data lines from 103(1) to 103(3*n*). Meanwhile, all TFTs 106 connected to the scanning line pass the image data on the data lines to the correspondent pixel electrodes 101 for displaying. After all the scanning lines from 102(1) to 102(*m*)** are scanned in sequence, the displaying of the whole picture frame is completed.

As described above, while processing the display of the pixels on a specified scanning line, scan driver IC 132 must send a logic high level signal to turn on all TFTs 106 on the scanning line. Accordingly, the image data on the data lines can be sent to the corresponding pixel electrodes 101. However, the case described above is ideal condition. In the real condition, since there is a delay effect caused by RC time constant of the conducting lines, the logic high level signal received by TFTs 106 connecting to the scanning line may undergo a severe distortion. FIG. 3 (Prior Art) is a schematic diagram of a conventional technique of a practical procedure for scanning the scanning lines. The logic high level pulse signal **133*a* sent from the scan driver IC 132 will turn on the nearest TFT 106 first. Nonetheless, when the logic high level pulse signal is transferred via the scanning line, the high frequency components are filtered out and a logic high level pulse signal 133*b* is produced due to the RC time constant of the resistance and the capacitance of the conducting line. The distorted logic high level pulse signal 133*b* could neither insure that the correspondent TFT 106 being provided with sufficient turn-on time to allow the image data to enter pixel electrode 101**, nor that the closing time of the previous TFT being fast enough to avoid been overlapped by the next data line. The phenomenon is going to get worse in the LCD modules with larger sizes and higher resolutions. For example, in the LCD with XGA type (with the size of about 13.3" to 14.1", and the resolution of 1024×768), the time for scanning each scanning line is about 20.67 ms. On the other hand, it will take 13.39 $\mu$s to scan each scanning line of the LCD with the UGXA type (with the size of 17", and the resolution of 1600×1200). Hence, when the size and resolution of a LCD get bigger, the delaying problem of the scanning line is getting more serious. This is the problem encountered when proceeding the driving of a conventional LCD module.

SUMMARY OF THE INVENTION

Therefore, the object of the present invention is to provide a LCD module, its scanning circuit board and the scanning method in order to equivalently decrease the effect of RC time constant on each scanning line. Thereby, insure the quality of the LCD module.

The present invention achieves the object described above by providing a LCD module comprising a LCD panel, a driving circuit unit, a first scanning unit and a second scanning unit. The LCD panel comprises a plurality of scanning lines parallel to the first side (the width side). The driving circuit unit emits the first scanning control signal and the second scanning control signal and sends them to the first scanning unit and the second scanning unit respectively. The first scanning unit is coupled between the scanning circuit unit and the second side (the first height side) of the LCD panel adjacent to the first side of the LCD panel, for receiving the first scanning signal and driving each scanning line in the LCD panel in sequence. The second scanning unit is coupled between the scanning circuit unit and the third side (the second height side) opposite to the second side of the LCD panel, for receiving the second scanning control signal and driving each scanning line in the LCD panel in order. The first and the second scanning unit scan one of scanning lines synchronously during scanning, therefore resulting in the reduction of the delay effect caused by the RC time constant.

Furthermore, the first scanning unit comprises a first scanning circuit board and a plurality of first scan driver ICs. The first scanning circuit board is couple connected to the driving circuit unit for receiving the first scanning control signal. In addition, the first scan driver ICs are coupled between the first scanning circuit board and the second side of the LCD panel for sequentially scanning the scanning lines described above in accordance with the first scanning control signal. Moreover, the second scanning unit comprises a second scanning circuit board and a plurality of second scan driver ICs. The second scanning circuit board is coupled connected to the driving circuit unit for receiving the second scanning control signal. The second scan driver ICs are coupled between the second scanning circuit board and the third side of the LCD panel to sequentially scan the scanning lines described above, in accordance with the second scanning control signal.

In addition, the first scanning circuit board and the second scanning circuit board have the same structure, that is, the same assembly component is used to implement the manufacturing of both circuit board. It helps to simplify the assembly components in manufacture line. In practice, while being used as the first scanning circuit board, the scanning circuit board is connected to first scan driver ICs 140 with its first side. On the other hand, if being used as a second scan circuit board, the scanning circuit board then, is connected to scan driver ICs 150 with its second side opposite to the first side. The connecting method is shown in FIG. 6*a* and FIG. 6*b*. The different first control signal and second control signal are sent to the first scan driver ICs and the second driver ICs via the first and the second scanning circuit board respectively with reverse scanning orders. That is, if every first scan driver IC scans along an incrementing dimension (from Y1 to Y240), the correspondent second driver IC scans along the decreasing dimension (from Y240 to Y1). Therefore, the first and the second scan driver IC proceed scanning of the same scanning line simultaneously.

Moreover, the first scanning control signal comprises the first data-shifting direction signal (R/L1), and the second scanning control signal comprises the second data-shifting direction signal (R/L2). Whereof, the first data-shifting direction signal of the first scanning control signal and the second data-shifting direction signal of the second scanning control signal have the reverse shifting directions. As shown in FIG. 6*a*, the shifting direction of every first scan driver IC has been from Y1 to Y240; On the other hand, as shown in FIG. 6*b*, the shifting direction of every second scan driver IC is from Y240 to Y1. The first forward scan activation signal (STVR1) of the first scanning control signal and the second backward scan activation signal (STVL2) of the second scanning control signal are connected to the connecting pins denoted as STV IN of the first scan driver IC 140*a* and the second scan driver IC 150*a* respectively for driving scanning procedure for each picture frame. Namely, the scan activation signals are respectively applied to drive the first scan driver IC 140*a* and the second driver IC 150*a*. After first scan driver IC 140*a* and second scan driver IC 150*a* finish the scanning, the connecting pin STV OUT passes the scanning signal to the next scan driver ICs (140*b* and 150*b*), in order to activate the scanning process. The scanning process repeats until scanning of all the scanning lines on the LCD panel is completed.

In addition, the present invention provides a scanning circuit board allocated in the LCD module with a LCD panel for connecting a plurality of driver ICs in order to proceed scanning. The LCD panel described above comprises a plurality of scanning lines extending from one side of the LCD panel described above to the other side of the LCD panel. Furthermore, the scanning circuit board comprises a connector for connecting an external connector and receiving a scan control signal and a first scanning interface on one side of the scanning circuit board for connecting and sending the scanning control signal and activating the scan driver ICs in order to start the scanning procedure of each of scanning lines from a side of the LCD panel, and a second scanning interface on the other side of the scanning circuit board for connecting and sending the scanning control signal to activate the scan driver ICs in order to start the scanning procedure of each of scanning lines from the other side of the LCD panel.

Moreover, the present invention provides a scanning method of a LCD panel which comprises the following steps. Firstly, the first scan driver IC and the second scan driver IC are assigned to two ends of every scanning line respectively. While scanning is proceeded, the first scan driver IC and the second scan driver IC scan through every scanning line in the LCD panel synchronously which causes the RC time constant effects to be reduced equivalently.

DETAIL DESCRIPTION OF THE PREFERRED EMBODIMENT

The present invention is to provide a solution to the delay effect caused by RC time constant. The present invention can be applied on the LCD with larger size and high resolution developed in the future. Firstly, scan driver ICs are located at the two ends of every scanning line in the LCD panel which are then activated for scanning while scanning is proceeded. The delay effect caused by the RC time constant can thus be reduced equivalently, and the greatest delay would occur at the center of the picture frame.

Figure 4:
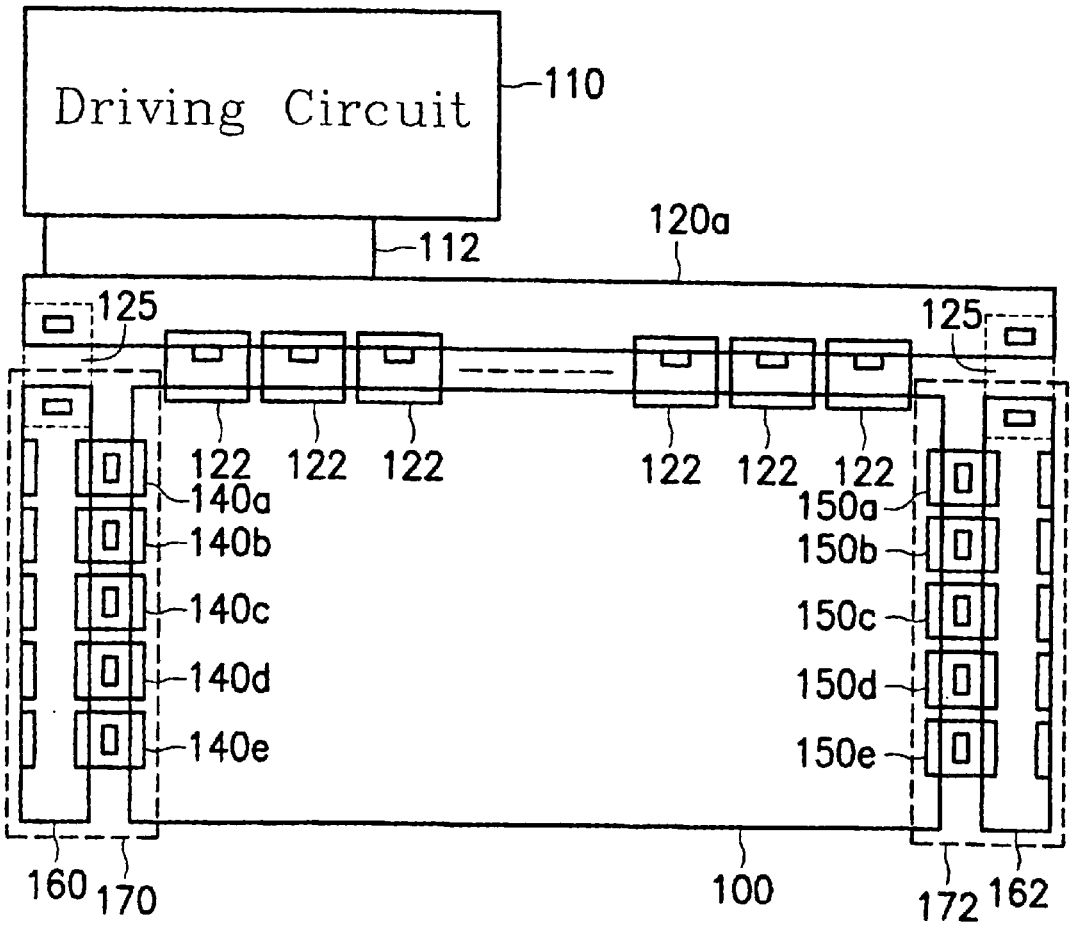
FIG. 4 is a plane view of the LCD module in accordance with the embodiment the present invention.

To implement the scanning method described above, the embodiment of LCD module in the present invention has to be different from the conventional techniques. FIG. 4 presents the plain view of the embodiment of the present invention, wherein, the elements the same with the conventional embodiment shown in FIG. 1 are label with the same number.

As shown in FIG. 4, the LCD module primarily comprises driving circuit 110, data circuit board 120*a*, data driver IC 122, scanning circuit board 160, scan driver ICs 14*a*~14*e*, scanning circuit board 162, scan driver IC 150*a*~150*e*, and LCD panel 100. It is assumed that LCD panel 100 of the embodiment has a resolvability of 1600×1200. If every scan driver IC (140*a*~140*e* or 150*a*~150*e*) contains 240 scanning channels, the embodiment of the present invention would need 10 driver ICs. In addition, if every data driver IC has 400 data channels, the embodiment of the present invention would contain 1600×3/400=12 data driver ICs.

Figure 1:
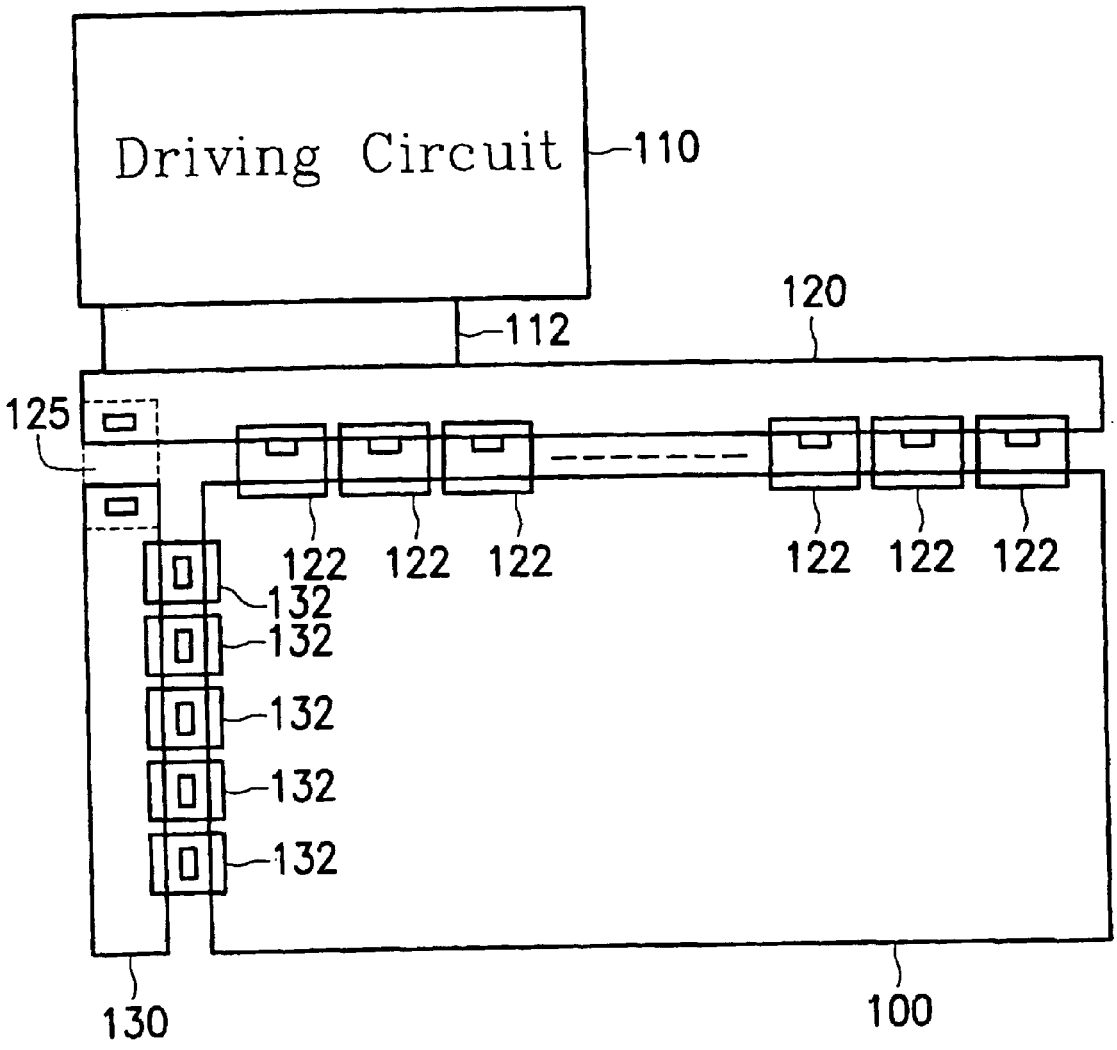
FIG. 1 (PRIOR ART)
FIG. 1(Prior Art) is a plane view of a conventional LCD module.
Figure 2:
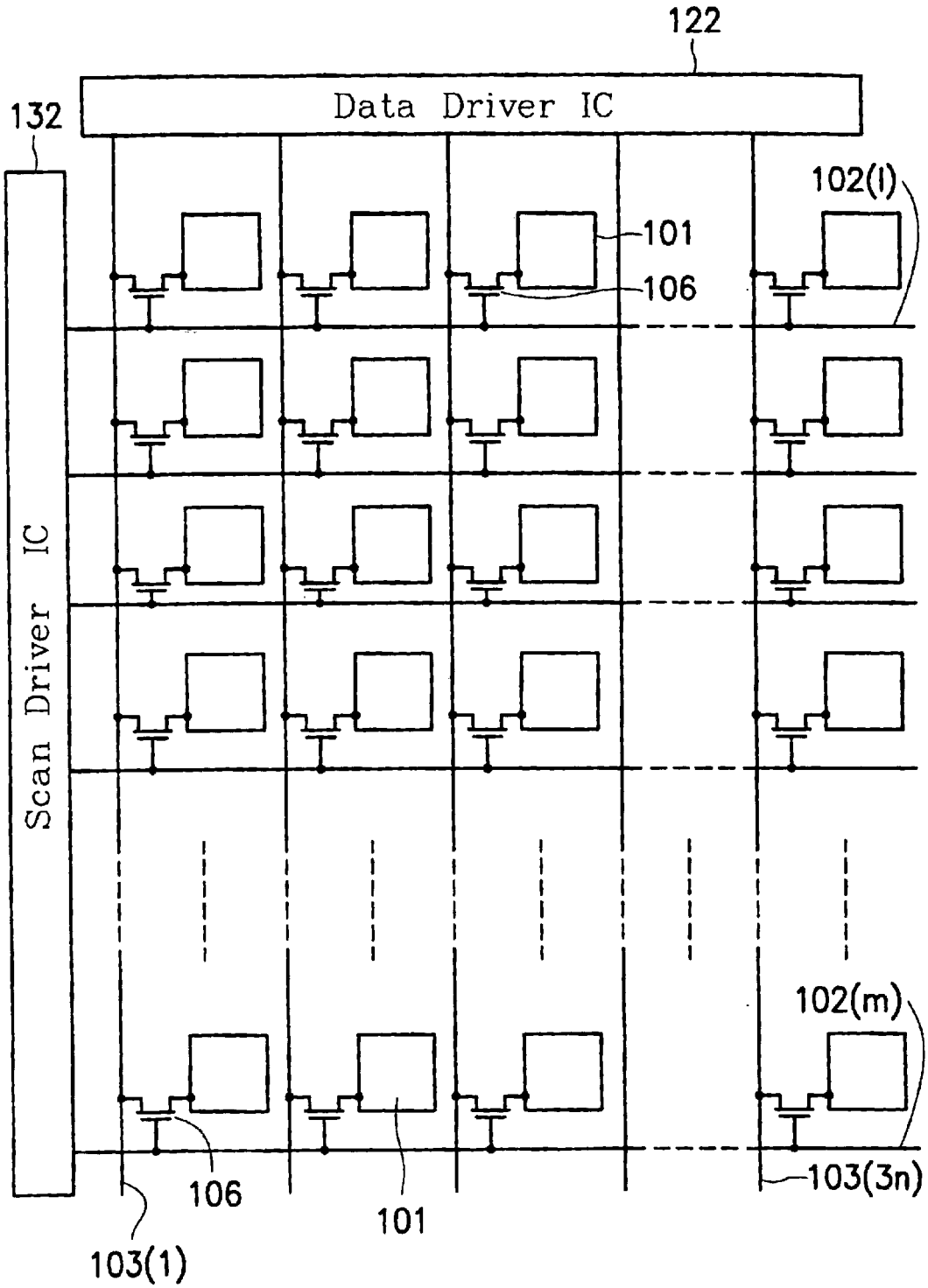
FIG. 2 (PRIOR ART)
FIG. 2 (Prior Art) is a circuit diagram of a conventional LCD panel.
Figure 3:
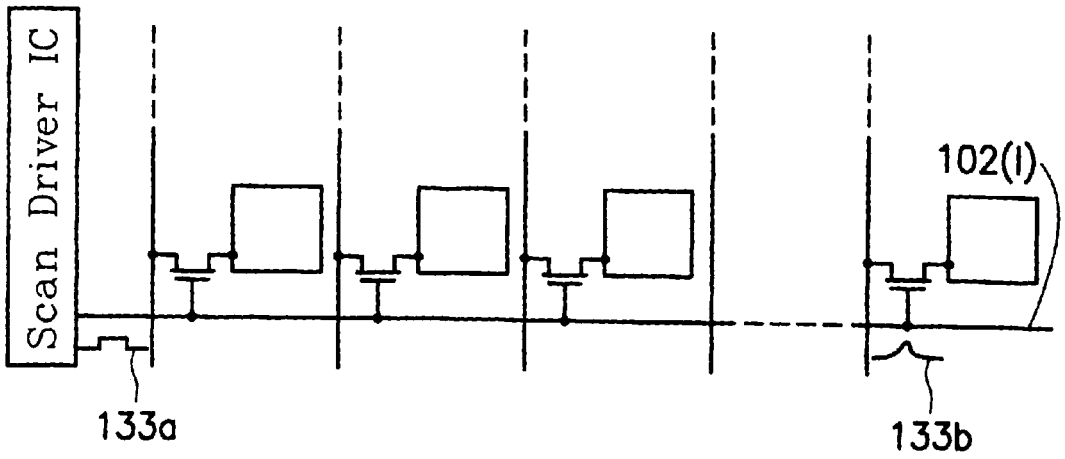
FIG. 3 (PRIOR ART)
FIG. 3 (Prior Art) is a schematic diagram for illustrating the scanning process in the prior art.

The difference between the present invention and the conventional technique shown in FIG. 1 are described as followed:

(1) At the opposite side of LCD panel 100, there is scanning unit 170 including scanning circuit board 160 and scan driver ICs 140*a*~140*e*, and scanning unit 172 including scanning circuit board 162 and scan driver ICs 150*a*~150*e*. Practically, scanning unit 170 and 172 scan every scanning line in LCD panel 100 synchronously.

(2) Driving circuit 110 sends a corresponding signal to scanning unit 170 and 172 respectively via connector 125 for adapting to different scanning conditions at both ends of the scanning line. Essentially, the first scanning control signal and the second scanning control signal contain the same signal lines which are slightly different in some aspect and will be explained later.

Figure 5:
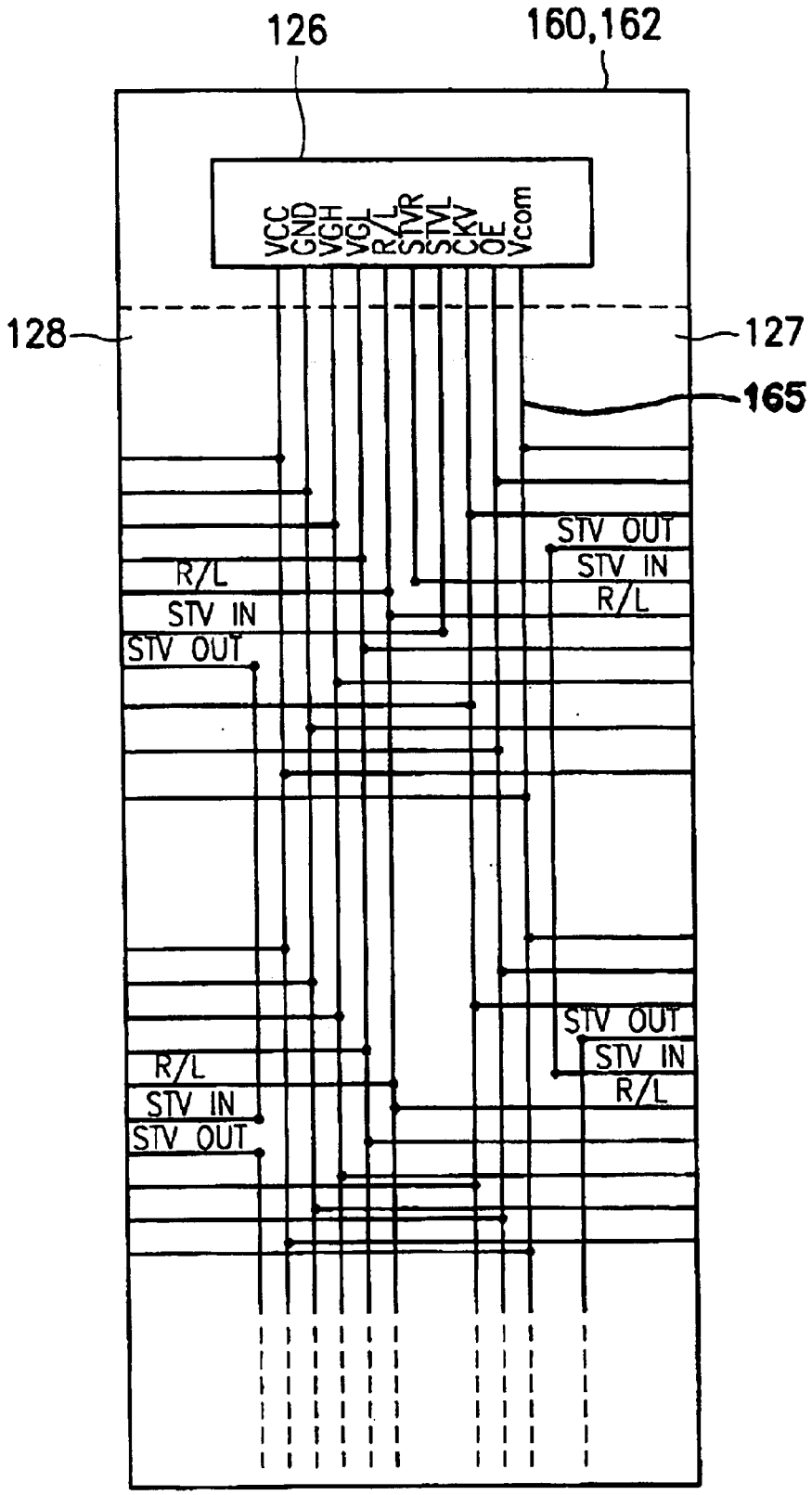
FIG. 5 is a schematic view of a scanning circuit board in accordance with the embodiment of the present invention.

The two features described is further explained in the following. Firstly, scanning circuit board 160 and scanning circuit board 162 are the same, that is the two circuit boards have the same layout. FIG. 5 represents a schematic plan view of the scanning circuit board (160 or 162) in accordance with the preferred embodiment. The scanning circuit board comprises connector 126, scanning interface 127, scanning interface 128 and on-board circuit 165. The connector 126 is connected to an external connector 125 for receiving the corresponding scanning control signals. Scanning interface 127 and scanning interface 128 are located at both sides of the scanning circuit board for connecting the external scan driver IC. On-board circuit 165 is used for sending the scanning control signal received to scanning interface 127 or scanning interface 128.

Figure 6A:
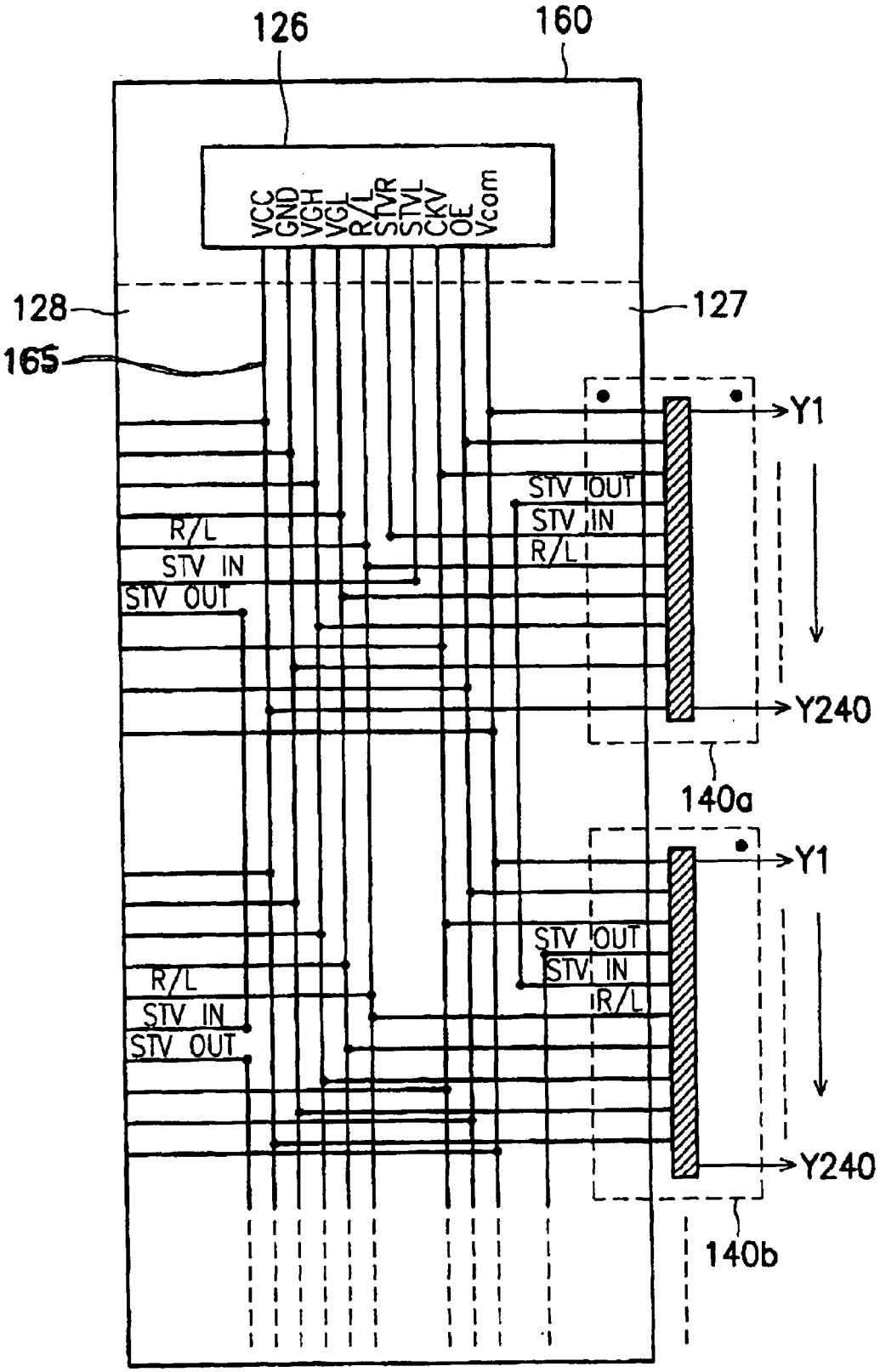
FIG. 6*a* is a schematic view of connection between the line scanning circuit board and the first scan driver IC in accordance with the embodiment of the present invention.

Each scanning circuit board only uses one of the scanning interface 127 or 128 at a time. When scanning interface 127 is used to connect the external scan driver ICs 140*a*~140*e*, as scanning circuit board 160 shown in FIG. 6*a*, each scan driver ICs 140*a*~140*e* is configured in a normal dimension. The input/output terminal of each scan driver IC comprises a controlling input terminal (connected to the side of the circuit board side) and a scanning output terminal (connected to the side of the LCD panel). Symbol "*" shown in the graph represents the location of the first pin. More specifically, all the scanning control signal lines (will be explained later) sent to scan driver IC 140*a*~140*e* are configured in a downward order. And pins for scan driver signals (Y1~Y240) are also applied in the same order. Meanwhile, scanning circuit board 160 is placed at the left side of LCD panel 100, with the scanning interface 128 not in use.

Figure 6B:
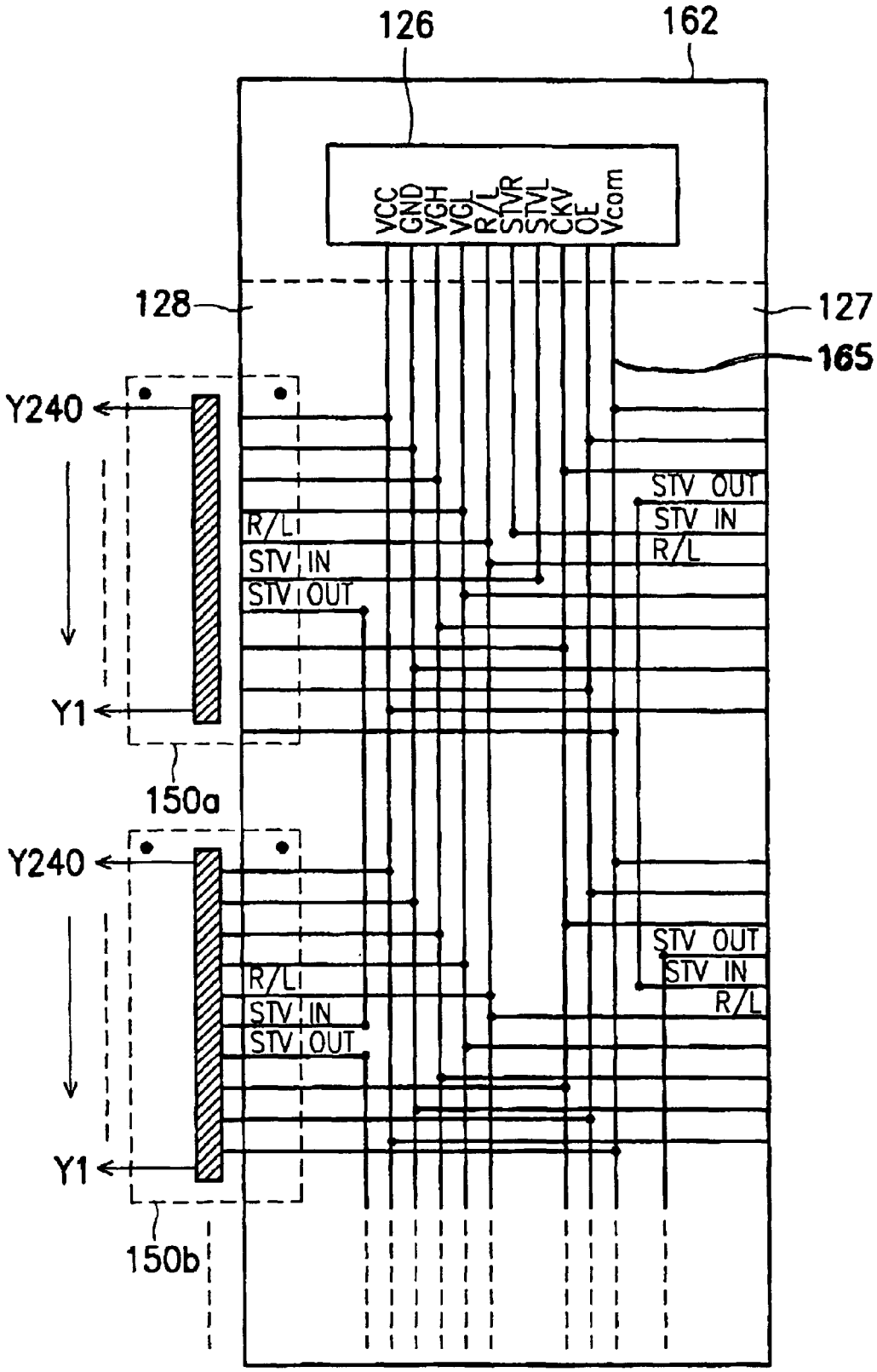
FIG. 6*b* is a schematic view of connection between the line scanning circuit board and the second scan driver IC in accordance with the embodiment of the present invention.

On the contrary, when scanning interface 128 is connected to external scan driver ICs 150*a*~150*e*, namely as the configuration of scanning circuit board 162 shown in FIG. 6*b*, each scan driver ICs 150*a*~150*e* is rotated by 180°. Meanwhile, scanning control signal sent to each scan driver IC 150*a*~150*e* is configured in an upward order. And pins for scan driving signal (Y1~Y240) are also in this reverse order. That is to say, when scanning is proceeded to the first scanning line, scan driver ICs 140*a* sends out scan driving signal Y1 (as the normal order), while scan driver IC 150*a* sends out scan driving signal Y240 (the reverse order). When proceeding scanning to the second scanning line, scan driver IC 140*a* sends out scan driving signal Y2 (as the normal order), and scan driver IC 150*a* then, sends out scan driving signal Y239 (the reverse order), and so forth. Meanwhile, scanning circuit board 162 is placed at the right side of LCD panel 100, with scanning interface 127 not in use.

As for on-board circuit 165, it is used to guide the scanning control signal input from connector 126 in accordance with the signal sequence defined by scanning interface 127 and scanning interface 128, so that the scanning circuit board could simultaneously be applied to the two different situations. Because the same circuit board is used on both scanning circuit board 160 and scanning circuit board 162 of the preferred embodiment, the types of manufacturing components in the assembly line can thus be reduced. Thereby the present invention facilitates the management at the production line.

In the preferred embodiment of the present invention, both the first scanning control signal or the second scanning control signal generated by driving circuit 110 comprise the 10 signal lines described below: (1) VCC (power source); (2) GND (ground); (3) VGH (the high level of the scanning signal); (4) VGL (the low level of the scanning signal); (5) R/L (representing the data shifting direction to be right, denoted by "R", or left, denoted by "L"); (6) STVR (forward scanning signal); (7) STVL (backward scanning signal); (8) CKV (vertical clock pulse); (9) OE (output enabling signal); and (10) VCOM (common electrode voltage). Referring to FIG. 5 and FIG. 6, the ten signal lines are allocated in the numbering order from the starting position "*." It is noticed that the signal line for the forward scanning signal STVR traces toward the right side of the scanning circuit board 160 (162), the signal line for the backward scanning signal STVL traces toward the left side of the scanning circuit board 160 (162), the signal lines for the other signals VCC, GND, VGH, VGL R/L, CKV OE and VCOM traces toward both the left and right side of the scanning circuit board 160 (162), and scan driver ICs 140*a*~140*e* and scan driver ICs 150*a*~150*e* are allocated in the reverse directions.

The first scanning control signal sent to scanning circuit 160 and the second scanning control signal sent to scanning circuit board 162 are different in the signal line R/L. The signal line R/L contained in the first scanning control signal is set as "R", which means the shifting direction is set as right, and the signal line R/L contains in the second scanning control signal is set as "L", which means the shifting direction is set as left. They are set to be the reverse directions. These signals could be implemented by using an inverter. Wherein, the first shifting positions of scan driver IC 140*a* and 150*a* are controlled by the pin of scan driver IC denoted by STVR/STVL of the scanning control signal, after all the 240 shifting are finished, scan driver IC 140*a* and 150*a* send a signal to scan driver IC 140*b* and 150*b* via the pin of scan driver IC denoted by STV OUT, as to continue the next 240 shifting procedure, the transference of signal continues until reaching scan driver IC 140*e* and 150*e*. At this time the scanning of all the scanning lines to be completed.

Thereby, it is possible for any of the scanning line in the LCD panel to be driven from both ends of the scanning line, which accordingly reduces the delay effect caused by RC time constant. In addition, since the scanning circuit board at both ends of the scanning lines have the same layout, and the scan driver IC at both ends of the scanning lines have the same integrated circuit (only opposite in configuration direction). As a result, embodiment of the present invention will not increase the cost for the preparation of the assembly components and hence easier for industrial usage.

While the preferred embodiment of the invention has been described using specific terms, the description has been for illustrative purpose only, and it is to be understood that changes may be made without departing to the spirit or scope of the following claim.

What is claimed is:

1. A liquid crystal display module, comprising:

a liquid crystal display panel having a plurality of scanning lines parallel to a first side of the liquid crystal display panel;

a driving circuit unit for generating a first scanning control signal and a second scanning control signal;

a first scanning unit, comprising:

a first scanning circuit board, coupled to the driving circuit unit, for receiving the first scanning control signal; and a plurality of first scan drivers, coupled between the first scanning circuit board and a second side of the liquid crystal display panel, for sequentially scanning the scanning lines according to the first scanning control signal; and a second scanning unit comprising:

a second scanning circuit board, coupled to the driving circuit unit, for receiving the second scanning control signal; and a plurality of second scan drivers, coupled to the second scanning circuit board and a third side of the liquid crystal display panel opposite to the second side of the liquid crystal panel, for sequentially scanning the scanning lines according to the second scanning control signal;

wherein the first scanning unit and the second scanning unit drive one of the scanning lines simultaneously;

the first scanning circuit board is the same as the second scanning circuit board; each scanning circuit board has a first connection port, a second connection port and a third connection port, the first scan drivers receive the first scanning control signal through the first and second connection ports, not through the third connection port, the second scan drivers receive the second scanning control signal through the first and third connection ports, not through the second connection port, and the scanning of the first scan drivers and the scanning of the second scan drivers are in reverse order.

2. The liquid display module as recited in the claim 1, wherein the first scan drivers and the second scan drivers are integrated circuits in tape carrier packages.

3. The liquid crystal display module as claimed in claim 1, wherein the first connection port is a connector, and the second and third connection port are scanning interfaces.

4. The liquid crystal display module as claimed in claim 1, wherein the first scanning control signal and the second scanning control signal are the same control signal.

5. A liquid crystal display module, comprising:

a liquid crystal display panel having a plurality of scanning lines parallel to a first side of the liquid crystal display panel;

a driving circuit unit for generating a first scanning control signal and a second scanning control signal;

a first scanning unit, comprising:

a first scanning circuit board, coupled to the driving circuit unit, for receiving the first scanning control signal; and a plurality of first scan drivers, coupled between the first scanning circuit board and a second side of the liquid crystal display panel, for sequentially scanning the scanning lines according to the first scanning control signal; and a second scanning unit comprising:

a second scanning circuit board, coupled to the driving circuit unit, for receiving the second scanning control signal; and a plurality of second scan drivers, coupled to the second scanning circuit board and a third side of the liquid crystal display panel opposite to the second side of the liquid crystal panel, for sequentially scanning the scanning lines according to the second scanning control signal;

wherein the first scanning unit and the second scanning unit drive one of the scanning lines simultaneously; the first scanning circuit board is the same as the second scanning circuit board; each scanning circuit board, located in a liquid crystal display module with a liquid crystal display panel, for connecting with a plurality of scanning drivers to scan a plurality of scanning lines extending from a first side of the liquid crystal display panel to a second side of the liquid crystal display panel, comprising:

a connector for connecting with an external connector and receiving a scanning control signal;

a first scanning interface, located at a first side of the scanning circuit board, for transferring the scanning control signal to the scan drivers connected with the first scanning interface and driving each of the scanning lines from the first side of the liquid crystal display panel;

a second scanning interface, located at a second side of the scanning circuit board opposite to the first side of the scanning circuit board, for transferring the scanning control signal to the scan drivers connected with the second scanning interface and driving each of the scanning lines from the second side of the liquid crystal display panel; and an on-board circuit, for sending the scanning control signal received to the first or second scanning interfaces;

wherein the scanning control signal contains a data-shifting direction signal; and the data-shifting direction signal sent to the first scanning interface and the second scanning interface represent reverse shifting directions.

6. The liquid display module as recited in the claim 5, wherein the first scan drivers and the second scan drivers are integrated circuits in tape carrier packages.

* * * * *